US006588494B1

(12) United States Patent
Mazurier et al.

(10) Patent No.: US 6,588,494 B1
(45) Date of Patent: Jul. 8, 2003

(54) METHOD FOR CONTINUOUS CASTING OF HIGHLY DUCTILE FERRITIC STAINLESS STEEL STRIPS BETWEEN ROLLS, AND RESULTING THIN STRIPS

(75) Inventors: Frédéric Mazurier, Bethune (FR); Philippe Paradis, Gresy sur Isere (FR)

(73) Assignee: Usinor, Puteaux (FR)

( * ) Notice: Subject to any disclaimer, the term of this patent is extended or adjusted under 35 U.S.C. 154(b) by 0 days.

(21) Appl. No.: 09/914,430

(22) PCT Filed: Feb. 29, 2000

(86) PCT No.: PCT/FR00/00498

§ 371 (c)(1),
(2), (4) Date: Dec. 10, 2001

(87) PCT Pub. No.: WO00/53817

PCT Pub. Date: Sep. 14, 2000

(30) Foreign Application Priority Data

Mar. 5, 1999 (FR) ..... 99 02749

(51) Int. Cl.[7] ..... B22D 11/06; C22C 38/18

(52) U.S. Cl. ..... 164/476; 164/480; 148/325; 148/542; 148/605

(58) Field of Search ..... 164/428, 480, 164/476; 148/325, 601, 605, 542

(56) References Cited

U.S. PATENT DOCUMENTS 6,106,638 A * 8/2000 Paradis et al. ..... 148/325

FOREIGN PATENT DOCUMENTS

EP 247264 A2 12/1987
EP 638653 A1 2/1995
EP 638653 * 2/1995
EP 881305 A1 12/1998

OTHER PUBLICATIONS

Patent Abstracts of Japan, vol. 1998, no. 11, Sep. 30, 1998 & JP 10 176223 Nippon Steel Corp. Jun. 30, 1998.

Patent Abstracts of Japan,m vol. 1995, No. 8, Sep. 29, 1995 & JP 07 118754 A Nippon Steel Corp. May 9, 1995.

* cited by examiner

*Primary Examiner*—Kuang Y. Lin
(74) *Attorney, Agent, or Firm*—Sughrue Mion, PLLC

(57) ABSTRACT

The invention relates to a process for the casting of thin strip having a thickness of less than 10 mm, made of ferritic stainless steel, directly from liquid metal between two rotating cooled rolls having parallel horizontal axes, characterized in that:

the said ferritic stainless steel contains (in percentages by weight) from 11 to 18% chromium, less than 1% manganese, less than 1% silicon and less than 2.5% molybdenum;

the said ferritic stainless steel has carbon and nitrogen contents, the sum of the contents not exceeding 0.05%;

the said ferritic stainless steel contains at least one of the stabilizing elements titanium, niobium, zirconium and aluminium and the sum of their contents is between 0.05 and 1%;

the other elements present are iron and the usual impurities resulting from the smelting.

The subject of the invention is also thin strip capable of being obtained by the above process.

3 Claims, No Drawings

METHOD FOR CONTINUOUS CASTING OF HIGHLY DUCTILE FERRITIC STAINLESS STEEL STRIPS BETWEEN ROLLS, AND RESULTING THIN STRIPS

BACKGROUND OF THE INVENTION

The invention relates to the continuous casting of metals, and more specifically to the continuous casting, directly from liquid metal, of ferritic-type stainless steel strip, the thickness of which is of the order of a few mm, using the process called "twin-roll casting".

In recent years considerable progress has been made in the development of processes for casting thin carbon steel or stainless steel strip directly from liquid metal. The process mainly used at the present time is that of casting the said liquid metal between two internally cooled rolls rotating about their horizontal axes in opposite directions and placed parallel to each other, the minimum distance between their surfaces being approximately equal to the thickness that it is desired to give the cast strip (for example a few mm). The casting space containing the liquid steel is defined by the lateral surfaces of the rolls, on which the solidification of the strip starts, and by lateral closure plates made of refractory which are applied against the ends of the rolls. The liquid metal starts to solidify on contact with the outer surfaces of the rolls, on which solidified "shells" form, arrangements being made for these shells to meet in the region of the "nip", that is to say the region where the distance between the rolls is a minimum.

Thin strip made of ferritic stainless steel obtained by twin-roll continuous casting exhibits considerable brittleness, making it difficult for the strip to undergo cold conversion during the usual operations such as decoiling, edge trimming or cold rolling. The poor ductility of twin-roll-cast strip is essentially explained by the very coarse-grained structure resulting from the rapid mode of solidification between the casting rolls, combined with a lengthy residence time at high temperature after the solidified strip has left the bite of the rolls. The high hardness of these ferritic grains supersaturated with interstitial elements, such as carbon and nitrogen, constitutes an aggravating factor with regard to the brittleness of the thin strip.

Several attempts have been made in the past to develop a process for the twin-roll casting of ferritic stainless steels having good ductility. They have relied largely on the addition of known stabilizing elements, such as titanium and niobium, and have imposed compositional limitations on the maximum content of austenite present at high temperature, denoted by the symbol γp. Combined with these compositional conditions were control of the cooling rate, application of hot rolling or control of the temperature at which the cast strip was coiled.

Thus, document EP-A-0,881,305 describes an unstabilized ferritic grade, obtained by direct twin-roll casting of strip, the strip then being coiled at a temperature of less than 600° C. The strip is then box-annealed, still in coiled form. Coiling below 600° C. makes it possible to limit the precipitation of carbides at the as-cast stage, and thus makes it possible to prevent them coalescing in the form of highly brittle continuous films during box annealing.

Document EP-A-0,638,653 recommends casting a ferritic grade having a chromium content which may be relatively high (13–25%), stabilized with titanium, niobium or aluminium (at least 0.05%), with low carbon and nitrogen contents, and having a negative γp index, γp being the maximum amount of austenite formed at high temperature. This parameter is defined by the Tricot and Castro equation and is calculated using the formula:

$$\gamma p = 420C\% + 470N\% + 23Ni\% + 9Cu\% + 7Mn\% - 11.5Cr\% - 11.5Si\% - 12Mo\% - 23V\% - 47Nb\% - 49Ti\% - 52Al\% + 189.$$

After casting, a strip is hot rolled with a reduction ratio of greater than 5% in the 950–1150° C. range, followed by slow cooling at less than 20° C./s or by soaking the strip at high temperature for more than 5 seconds. The strip is then coiled at below 700° C. According to that document, the aim is to avoid the formation of austenite at high temperature by imposing a negative γp index in order to prevent the formation of martensite on the strip, which would make it brittle. The presence of stabilizers results, because of the rapid solidification, in fine embrittling precipitates. The hot rolling together with the high-temperature soak and the slow cooling are conducive to precipitation, and especially coalescence, of these precipitates, which thus become innocuous. Cold coiling makes it possible to prevent the formation of brittle intermetallic phases.

Document JP-A-08283845 recommends asynchronous hot rolling of a cast strip with an initial thickness of less than 10 mm, this having the effect of improving the ductility by refining the structure of thin strip by recrystallization. The casting is followed by asynchronous hot rolling and a heat treatment. What is attempted here is to improve the ductility of the thin strip by a recrystallization treatment.

Document JP-A-08295943 uses another estimate of the maximum amount of hot-formed austenite, in the absence of stabilizing elements. This parameter γ'p is calculated from:

$$\gamma' p = 420C\% + 470N\% + 23Ni\% + 7Mn\% - 11.5Cr\% - 11.5Si\% - 52Al\% + 189.$$

A strip whose γ'p index is greater than 25% is cast between rolls, the strip is hot rolled with a reduction ratio of greater than 20% at less than 1200° C., then coiled and the coils box-annealed between 700 and 900° C. for 4 hours. The aim is to obtain strip with an excellent surface quality, without being especially concerned about its ductility.

SUMMARY OF THE INVENTION

All these processes require special heat treatments, possibly necessitating special plants, possibly being expensive in terms of energy and, in the case of box annealing, also lengthy. The economic advantages provided by direct casting of thin strip are therefore to a large part diminished by these processes.

The object of the invention is to provide steelmakers with a process for manufacturing, by twin-roll casting, thin ferritic stainless steel strip that then has to undergo conventional cold conversion steps, without the need for complex or expensive operations such as controlled cooling of the strip or box annealing in order to give said strip good ductility.

With this objective in mind, the subject of the invention is a process for the casting of thin strip having a thickness of less than 10 mm, made of ferritic stainless steel, directly from liquid metal between two rotating cooled rolls having parallel horizontal axes, characterized in that:

- the said ferritic stainless steel contains (in percentages by weight) from 11 to 18% chromium, less than 1% manganese, less than 1% silicon and less than 2.5% molybdenum;
- the said ferritic stainless steel has carbon and nitrogen contents, the sum of the contents not exceeding 0.05%;

the said ferritic stainless steel contains at least one of the stabilizing elements titanium, niobium, zirconium and aluminium and the sum of their contents is between 0.05 and 1%;

the other elements present are iron and the usual impurities resulting from the smelting;

the γp index of the said ferritic stainless steel is greater than or equal to 30, where:

$$\gamma p = 420C\% + 470N\% + 23Ni\% + 9Cu\% + 7Mn\% - 11.5Cr\% - 11.5Si\% - 12Mo\% - 23V\% - 47Nb\% - 49Ti\% - 52Al\% + 189$$

and in that, after casting, the thin strip is coiled at a temperature of less than 600° C.

The subject of the invention is also thin strip capable of being obtained by the above process.

As will have been understood, the invention consists in combining the presence of one or more stabilizing elements in significant amounts with contents of other alloying elements which nevertheless keep the γp index at a high value, and in coiling the strip at a relatively low temperature. The combination of stabilizing elements and a high γp index, and especially its combination with a low coiling temperature which makes it possible to reconcile these compositional characteristics with very good ductility of the strip without, furthermore, it being necessary to carry out controlled cooling of the strip or a heat treatment which is expensive both in terms of energy and time, is not known in the prior art.

The various characteristics are determined by the following considerations.

A chromium content greater than 11% complies with the usual requirements encountered in ferritic stainless steels. The 18% maximum is justified in that, above this limit, the ductile-brittle transition temperature of stainless steels increases considerably and the invention then becomes inoperable. Chromium also has the tendency to lower the value of the γp index substantially.

DETAILED DESCRIPTION OF THE INVENTION

The silicon and molybdenum contents are maintained at 1% and 2.5% at most, respectively, so as to avoid the formation of intermetallic compounds or the formation of σ- or χ-type intermetallic phases. The maximum silicon content is, moreover, neither higher nor lower than those encountered in conventional ferritic grades, and the same is true of the 1% maximum manganese content.

The total content of stabilizing elements, namely of titanium, niobium, zirconium and aluminium, must be greater than or equal to 0.05% in order for them to be able to fulfil their usual function. Above 1%, problems of castability of the liquid steel through the nozzles of the caster are observed, as is the presence of surface defects on the strip which may constitute fracture initiators. Care must also be taken to ensure that a significant content of stabilizing elements does not lower the γp index to a value which would be excessively low, if, moreover, silicon, molybdenum and vanadium are present in high contents. At the same time, the total carbon and nitrogen content must not exceed 0.05% in order to avoid forming an excessive amount of embrittling carbides or carbonitrides.

When the γp index is less than 30%, the ferrite-austenite two-phase structure at high temperature, after the end of solidification, is not sufficient for it to be possible for the structure of the strip to be refined and the ductility of the cast product to be substantially improved. If the γp index is greater than 60%, the ductility deteriorates since the contraction resulting from the high-temperature ferrite- to austenite phase transformation carries the risk of causing the appearance of surface defects, such as cracks, which constitute as many possible fracture initiators during the subsequent conversion operations.

Moreover, if the coiling temperature is greater than 600°0 C., embrittling precipitates are formed and the problem posed is not solved.

Examples of application of the invention will now be given and compared with control examples. All these examples relate to the casting of ferritic stainless steels having a relatively low chromium content (approximately 11.5%), but it is understood that comparable results may be obtained with steels having higher chromium contents, within the 18% limit, as specified above. These steels were cast as strip 3 mm thick on leaving the rolls. Table 1 gives the compositions (in percentages by weight) of the steels forming the subject of the trials; steels A and B have compositions according to the requirements of the invention, steel C is given by way of reference.

TABLE 1

Chemical composition of the steels studied

| Grade | C % | Mn % | P % | S % | Si % | Ni % | Cr % | Cu % | Mo % | Nb % | V % | Ti % | N % | Al % | γp % |
|---|---|---|---|---|---|---|---|---|---|---|---|---|---|---|---|
| A | 0.012 | 0.290 | 0.015 | 0.001 | 0.560 | 0.090 | 11.497 | 0.022 | 0.0006 | 0.002 | 0.079 | 0.178 | 0.010 | 0.005 | 53.6 |
| B | 0.014 | 0.225 | 0.017 | 0.002 | 0.471 | 0.088 | 11.514 | 0.009 | 0.042 | 0.288 | 0.045 | 0.003 | 0.011 | 0.002 | 50.6 |
| C | 0.011 | 0.282 | 0.015 | 0.001 | 0.688 | 0.065 | 11.711 | 0.028 | 0.0010 | 0.354 | 0.050 | 0.299 | 0.010 | 0.009 | 26.5 |

Grades A, B and C are essentially distinguished in that grade A is stabilized with titanium, grade B is stabilized with niobium and grade C is stabilized by both these elements. In the latter grade, the simultaneous presence of relatively high contents of these two stabilizers, as well as the higher silicon content than in grades A and B, have resulted in a reduction in the γp index below the 30% limit required by the invention.

Table 2 gives the conditions for particular trials to which the above steels were subjected, in terms of reduction ratio and temperature during hot rolling if any, and in terms of coiling temperature. The table also gives the results of the flexural impact tests on Charpy test specimens to which the strips were subjected after they had been coiled, for the purpose of determining their fracture energy at a temperature of 0° C. For this purpose, V-notched test specimens were used. It is considered that a fracture energy of less than 40 J/cm$^2$ is insufficient to give the strip properties guaranteeing incident-free uncoiling and to allow the usual cold conversion operations.

TABLE 2

Strip-treatment conditions and results of the flexural impact tests carried out on Charpy test specimens

| Trial | Grade | Hot-rolling reduction ratio (%) | Hot-rolling temperature (° C.) | Coiling temp-erature (° C.) | Fracture energy at 0° C. (J/cm$^2$) |
|---|---|---|---|---|---|
| 1 (control) | A | — | — | 800 | 35 |
| 2 (invention) | A | — | — | 500 | 85 |
| 3 (control) | B | — | — | 800 | 20 |
| 4 (control) | C | — | — | 500 | 30 |
| 5 (control) | A | 10 | 1000 | 800 | 34 |
| 6 (invention) | A | 10 | 1000 | 500 | 185 |

Trials 1 to 3 were carried out on steels whose γp index was greater than 30%, according to the invention. They illustrate the beneficial effect of coiling at low temperature on the ductility of the strip, in that only trial 2 in which the coiling took place at 500° C. gave rise to satisfactory ductility in the cast strip, since the formation of embrittling precipitates in the coiled steel was successfully avoided. This was not possible when the coiling is carried out at 800° C. (trials 1 and 3) and the fracture energy in the Charpy test then lay below the 40 J/cm$^2$ lower limit that is regarded as being satisfactory.

In trial 4, the coiling was indeed carried out at a temperature of 500° C., according to the invention, and the formation of embrittling precipitates was not observed. However, this trial related to a grade whose γp index was less than the 30% required by the invention, and the amount of austenite formed at high temperature was insufficient to allow very substantial refinement of the coarse-grained structure obtained after solidification. Consequently, and despite the presence of a large amount of stabilizing elements, the post-coiling ductility of the strip was no more satisfactory than in trials 1 and 3.

During trials 5 and 6, the influence on the strip of hot rolling, carried out on leaving the rolls before coiling, was examined. This rolling was carried out at a temperature of 1000° C. with a strip-thickness reduction ratio of 10%. It was found (trial 5) that the refining of the initial structure, caused by such hot rolling, is not, however, sufficient to compensate for the negative effects on the ductility of the strip of coiling at high temperature (800° C.). On the other hand, if the strip hot-rolled under such conditions is coiled at quite a low temperature, in order to be according to the invention (500° C., trial 6), a considerable improvement in the ductility is obtained, compared with that observed on the same steel in trial 2 in the absence of hot rolling, even though this ductility was already satisfactory.

What is claimed is:

1. A process for the casting of thin strip having a thickness of less than 10 mm, made of ferritic stainless steel, directly from liquid metal between two rotating cooled rolls having parallel horizontal axes, said method comprising the steps of:

providing said ferritic stainless steel with a content, in percentages by weight, from 11 to 18% chromium, less than 1% manganese, less than 1% silicon and less than 2.5%, but greater than 0%, molybdenum;

providing said ferritic stainless steel with carbon and nitrogen contents, the sum of the contents not exceeding 0.05%;

providing said ferritic stainless steel with contents of at least one of stabilizing elements titanium, niobium, zirconium and aluminium so that the sum of their contents is between 0.05 and 1%;

providing other elements in the form of iron and the usual impurities resulting from melting;

choosing the γp index of said ferritic stainless steel to be greater than or equal to 30%, where:

$$\gamma p = 420C\% + 470N\% + 23Ni\% + 9Cu\% + 7Mn\% - 11.5Cr\% + 11.5Si\% - 12Mo\% 23V\% - 47Nb\% - 49Ti\% - 52A1\% + 189;$$

and, after casting, coiling the thin strip at a temperature of less than 600° C.

2. Process according to claim 1, characterized in that the said cast strip, before it is coiled, undergoes hot rolling between 1200 and 900° C. with a reduction ratio of greater than 5%.

3. Process according to claim 1, characterized in that the γp index of the said ferritic stainless steel is between 30 and 60%.

* * * * *